US005562428A

United States Patent [19]

Bailey et al.

[11] Patent Number: 5,562,428

[45] Date of Patent: Oct. 8, 1996

[54] FUEL INJECTION PUMP HAVING AN ADJUSTABLE INLET POPPET VALVE

[75] Inventors: Francis V. Bailey, Racine; William R. Krueger, New Berlin, both of Wis.

[73] Assignee: Outboard Marine Corporation, Waukegan, Ill.

[21] Appl. No.: 418,502

[22] Filed: Apr. 7, 1995

[51] Int. Cl.[6] ..... F04B 7/04

[52] U.S. Cl. ..... 417/417; 417/490; 417/499; 417/505; 251/129.18; 123/504

[58] Field of Search ..... 417/417, 490, 417/497, 499, 505, 506; 251/129.18, 129.21, 129.02; 123/499, 503, 504

[56] References Cited

U.S. PATENT DOCUMENTS

| | | | |
|---|---|---|---|
| 2,987,293 | 6/1961 | Knudson . | |
| 3,429,552 | 2/1969 | Huley et al. . | |
| 4,431,381 | 2/1984 | Falendysz et al. | 417/490 |
| 4,640,391 | 2/1987 | Maehara et al. . | |
| 4,917,351 | 4/1990 | Lindbloom et al. . | |
| 5,029,807 | 7/1991 | Fuchs . | |
| 5,044,563 | 9/1991 | Mesenich . | |
| 5,218,999 | 6/1993 | Tanimoto . | |
| 5,355,856 | 10/1994 | Paul et al. . | |
| 5,357,933 | 10/1994 | Kasahara et al. . | |
| 5,357,944 | 10/1994 | Rathmayr . | |

FOREIGN PATENT DOCUMENTS

| | | | |
|---|---|---|---|
| 463501 | 3/1950 | Canada | 251/129.21 |
| 1278745 | 12/1961 | France | 417/417 |

*Primary Examiner*—Charles Freay
*Assistant Examiner*—Roland G. McAndrews, Jr.
*Attorney, Agent, or Firm*—Michael, Best & Friedrich

[57] ABSTRACT

A fuel injection pump driven by an electric coil, the pump including a poppet valve slidable within a fuel passage in an armature structure and relative thereto in response to movement of the armature structure relative to the pump housing and through a stroke length between a first position permitting flow in a fuel passage from a low pressure fuel chamber to a high pressure fuel chamber, and a second position preventing fuel flow between the high and low pressure fuel chambers, and comprising a head portion located in the high pressure fuel chamber and including a valve surface which is spaced from the valve seat when the poppet valve is in the first position permitting fuel flow from the low pressure fuel chamber to the high pressure fuel chamber, and which is sealingly engaged with the valve seat when the poppet valve is in the second position preventing fuel flow between the high and low pressure fuel chambers, an adjustment member extending in a bore in the housing wall and being engageable with the poppet valve to control the stroke length thereof between the fuel flow permitting and fuel flow preventing positions, and an arrangement for displacing the adjustment member relative to the housing end wall to variably determine the stroke length of the poppet valve.

4 Claims, 1 Drawing Sheet

FUEL INJECTION PUMP HAVING AN ADJUSTABLE INLET POPPET VALVE

RELATED APPLICATION

Attention is directed to copending application Ser. No. 276,545, filed Jul. 18, 1994.

BACKGROUND OF THE INVENTION

The invention relates generally to internal combustion engines and, more particularly, to fuel injector systems for such engines. Still more particularly, the invention relates to solenoid operated axial flow fuel pumps and to pressure surge fuel injection mechanisms or valves.

Attention is directed to the following U.S. Pat. Nos.:

2,987,293—Issued Jun. 6, 1961

3,429,552—Issued Feb. 25, 1969

4,640,391—Issued Feb. 3, 1987

4,917,351—Issued Apr. 17, 1990

5,029,807—Issued Jul. 9, 1991

5,044,563—Issued Sep. 3, 1991

5,218,999—Issued Jun. 15, 1993

5,355,856—Issued Oct. 18, 1994

5,357,933—Issued Oct. 25, 1994

5,357,944—Issued Oct. 25, 1994

Attention is directed to the following foreign patents:

4-183958—Japan—Issued Jun. 30, 1992

DE 41 07 622 A 1—Germany—Issued Oct. 9, 1992

SUMMARY OF THE INVENTION

The invention provides a fuel injection pump comprising a housing including a wall having therein a bore, a low pressure fuel chamber communicating with a source of low pressure fuel, and a high pressure fuel chamber having a pressure controlled fuel outlet, an armature structure movably mounted in the housing for movement in a first direction pressurizing the fuel in the high pressure chamber and in an opposite direction, and including a fuel passage communicating between the low pressure fuel chamber and the high pressure fuel chamber and including therein a valve seat, an electrical coil mounted on the housing and operable, when energized, to cause armature structure movement in the first direction, a spring located in the housing and operable, when the coil is deenergized, to cause armature structure movement in the opposite direction, a poppet valve slidable within the fuel passage in the armature structure and relative thereto in response to movement of the armature structure relative to the housing and through a stroke length between a first position permitting flow in the fuel passage from the low pressure fuel chamber to the high pressure fuel chamber, and a second position preventing fuel flow between the high and low pressure fuel chambers, and comprising a head portion located in the high pressure fuel chamber and including a valve surface which is spaced from the valve seat when the poppet valve is in the first position permitting fuel flow from the low pressure fuel chamber to the high pressure fuel chamber, and which is sealingly engaged with the valve seat when the poppet valve is in the second position preventing fuel flow between the high and low pressure fuel chambers, an adjustment member extending in the bore in the housing wall and being engageable with the poppet valve to control the stroke length thereof between the fuel flow permitting and fuel flow preventing positions, and means for displacing the adjustment member relative to the housing end wall to variably determine the stroke length of the poppet valve.

The invention also provides a fuel injection pump comprising an elongated housing including an end wall including having therein a central bore, an armature structure movably mounted in the housing, partially defining, with the housing, an outer fuel chamber communicating with a source of low pressure fuel, partially defining an inner fuel chamber having a pressure controlled fuel outlet, and including a central bore, a counter bore extending from the central bore in the direction away from the end wall of the housing, communicating with the outer and inner fuel chambers, and including a valve seat between the outer and inner fuel chambers, and a poppet valve slidable within the central bore of the armature structure and relative thereto in response to movement of the armature structure relative to the housing and through a stroke length between first position permitting fuel flow between the outer and inner fuel chambers, and second position preventing fuel flow between the outer and inner fuel chambers, and including a head portion located in the inner fuel chamber and including a valve surface which is spaced from the valve seat when the poppet valve is in the first position permitting fuel flow from the outer fuel chamber to the inner fuel chamber, and which is sealingly engaged with the valve seat when the poppet valve is in the second position preventing fuel flow between the outer and inner fuel chambers, an adjustment member extending in the axial bore in the end wall of the housing and engageable with the poppet valve, and means for axially displacing the adjustment member relative to the housing end wall to variably determine the stroke length of the poppet valve.

The invention also provides a fuel injection pump comprising a housing including an elongated wall having an axis, and an end wall which includes therein an axial extending bore and which, together with the elongated wall, partially defines an outer fuel chamber communicating with a source of low pressure fuel, an elongated member fixedly extending coaxially with the elongated wall and including an end spaced from the housing end wall, an armature structure movably mounted on the elongated member, defining with the elongated member an inner fuel chamber having a pressure controlled fuel outlet, and including a central bore extending coaxially with the elongated wall, a counter bore extending from the central bore toward the end of the elongated member and including a valve seat, and a fuel passage extending radially between the counter bore and the low pressure fuel chamber, a poppet valve including a stem portion slidable within the central bore of the armature structure and relative thereto in response to movement of the armature structure relative to the elongated member and through a stroke length between a first position permitting fuel flow between the outer and inner fuel chambers, and a second position preventing fuel flow between the outer and inner fuel chambers, and a head portion extending from the stem portion, located in the inner fuel chamber between the elongated member and the valve seat and including a valve surface which is spaced from the valve seat when the poppet valve is in the first position permitting fuel flow through the fuel passage and the counter bore from the outer fuel chamber to the inner fuel chamber, and which is sealingly engaged with the valve seat when the poppet valve is in the second position preventing fuel flow between the outer and inner fuel chambers through the counter bore and the fuel passage, an adjustment member extending in the axial bore in the end wall of the housing and engageable with the stem portion of the poppet valve, and means for axially displacing the adjustment member relative to the housing end wall to variably determine the stroke length of the poppet valve.

The invention also provides a fuel injection pump comprising a one piece housing member including a cylindrical wall, an end wall which, together with the cylindrical wall, defines a low pressure fuel pumping chamber and which includes therein an axial bore extending coaxially with the cylindrical wall, a tubular member fixedly extending coaxially with the cylindrical wall and including an end spaced from the end wall of the housing member, an outer surface, and an interior bore defining a pressure controlled fuel outlet, an armature assembly including an armature structure partially defining a high pressure fuel chamber communicating with the interior bore of the tubular member and being slideably mounted on the tubular member for movement in a first direction pressurizing the fuel in the high pressure fuel chamber and in a second direction opposite to the first direction, and including a first end adjacent the tubular member, a second end remote from the tubular member, an inner bore extending from the first end and having an inner surface slidingly and sealingly engaged with the outer surface of the tubular member, a transverse flange surface extending from the inner bore in axially spaced relation from the end of the tubular member, and a bushing located at the second end of the armature structure and having a central bore extending coaxially with the cylindrical wall and including an end axially spaced from the end of the tubular member, a counter bore extending from the end of the central bore of the bushing toward the end of the tubular member and having a valve seat, and a fuel passage extending radially between the counter bore and the low pressure fuel chamber, and a poppet valve including a stem portion having a first end having a transverse surface remote from the end of the tubular member, an outer surface extending from the transverse surface in slidable and sealing engagement with the central bore of the bushing to afford movement of the poppet valve relative to the armature structure in response to movement of the armature structure relative to the tubular member through a stroke length between a first position permitting fuel flow through the fuel passage and the counter bore from the low pressure fuel chamber to the high pressure fuel chamber, and a second position preventing fuel flow between the high and low pressure fuel chambers, a second end, and a head portion located in the high pressure fuel chamber between the flange surface of the armature structure and the valve seat and including a valve surface which is spaced from the valve seat when the poppet valve is in the first, fuel flow permitting position and which is sealingly engaged with the valve seat when the poppet valve is in the second, fuel flow preventing position, an adjustment member extending in the axial bore in the end wall of the housing member and having an outer end engageable with the end surface of the plunger, and means for axially displacing the adjustment member relative to the end wall of the housing member to variably determine the stroke length of the poppet valve.

Other features and advantages of the invention will become apparent to those skilled in the art upon review of the following detailed description, claims and drawings.

Figure 1:
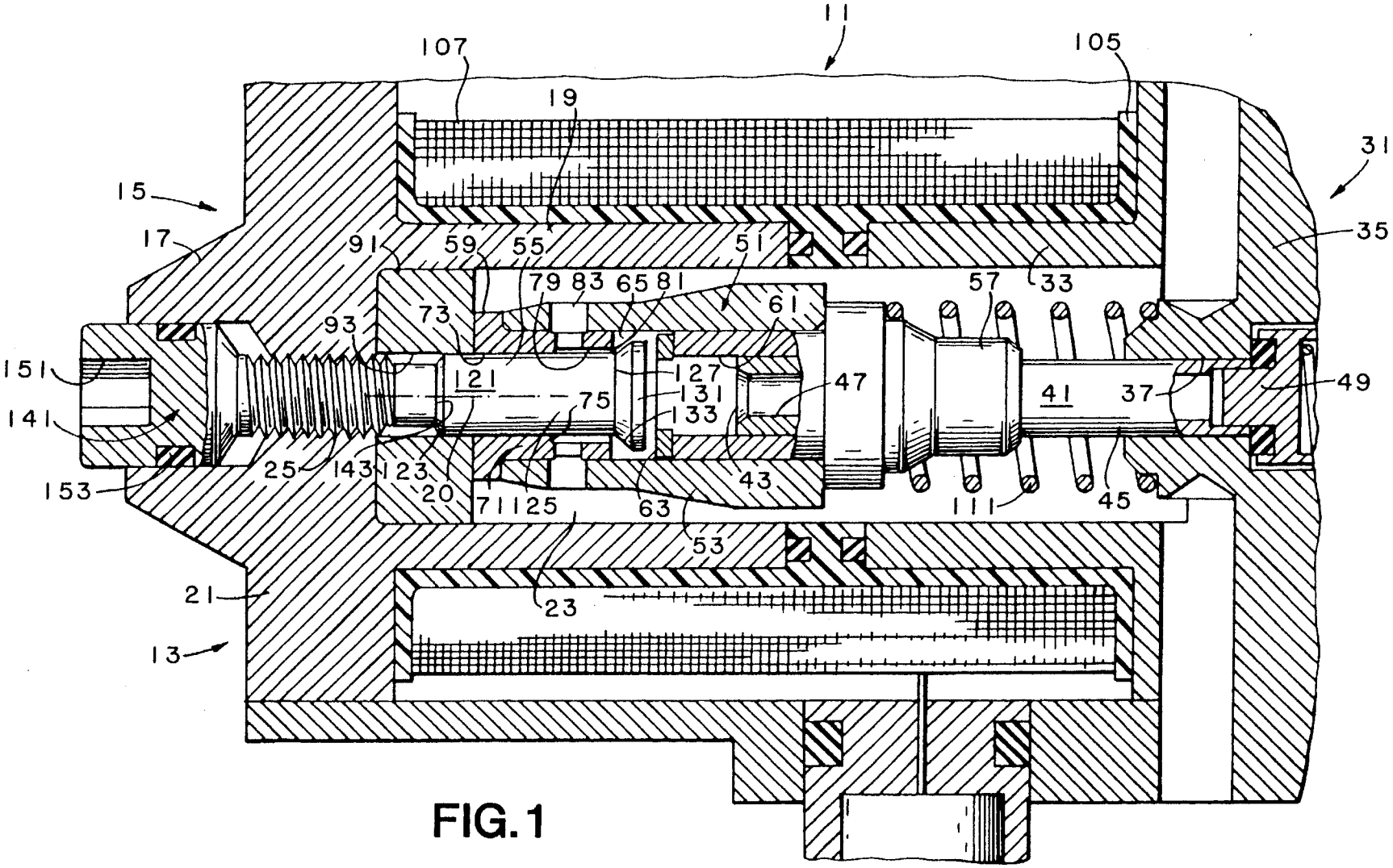
FIG. 1 is a fragmentary view of a combined fuel injection pump and nozzle which incorporates various of the features of the invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is understood that the phraseology and terminology used herein is for the purpose of description and should not be regarded as limiting.

DESCRIPTION OF THE PREFERRED EMBODIMENT

Shown fragmentarily in the drawings is a combined fuel injection pump and nozzle assembly 11 which, in general, and except as will appear hereinafter, is in accordance with the combined fuel injection pump and nozzle which is disclosed in copending application Ser. No. 276,545, filed Jul. 18, 1994 and which is incorporated herein by reference. The combined assembly 11 includes a fuel injection pump 13 comprising a housing assembly 15 including a housing member 17 which is preferably of one piece construction and which includes an inner, elongated cylindrical wall 19 having an axis 20. The housing member 17 also includes an end wall 21 which, together with the cylindrical wall 19, partially define an outer or low pressure fuel pumping chamber 23. The end wall 21 includes therein an axial bore 25 extending coaxially with said cylindrical wall 19.

The fuel housing assembly 15 also includes a second or other housing member 31 which is also preferably of one piece construction and which includes an inner, elongated cylindrical wall 33 which is in alignment with the inner wall 19. The housing member 31 also includes an end wall 35 which, together with the cylindrical wall 33, also partially define the outer or low pressure fuel pumping chamber 23. The end wall 35 includes therein a central or axial bore 37 extending coaxially with the cylindrical wall 19.

The fuel injection pump 13 also includes a tubular member 41 which fixedly extends coaxially with the cylindrical walls 19 and 33 and into and from the axial or central bore 37 in the end wall 35 of the second housing member 31 and toward the housing member 17. The tubular member 41 includes an inner end 43 spaced from the end wall 21 of the housing member 17, an outer surface 45, and an interior bore 47 including a high pressure outlet valve 49 defining a fuel outlet.

The fuel injection pump 13 also includes an armature and valve assembly 51 which includes an armature structure or member 53 which can be suitably constructed and is slideably mounted in sealing engagement on the outer surface 45 of the tubular member 41 for movement between a low pressure position and a high pressure position. The assembly 51 also includes a poppet valve or plunger 55 which is moveable relative to the armature structure 53 as will be described hereinafter.

The armature structure or member 53 includes a first end 57 which is slidable on the tubular member 41, and a second end 59 located remotely to the left in the drawings from the tubular member 41. The armature structure 53 also includes an inner or central bore 61 extending from the first end 57 and having an inner surface slidingly and sealingly engaged with the outer surface 45 of the tubular member 41. In addition, the armature structure 53 also includes a transverse flange surface 63 extending from the inner bore 61 in axially spaced relation from the inner end 43 of the tubular member 41 and, in part, defining an inner, high pressure fuel chamber 65 communicating with the interior bore 47 of the tubular member 41.

Still further in addition, the armature structure or member 53 includes, at the second end 59, a bushing 71 having a central bore 73 extending coaxially with the cylindrical walls 19 and 33. The central bore 73 includes an end 75 axially spaced from the end 43 of the tubular member 41, a counter bore 79 extending from the end 75 of the central bore 73 of the bushing 71 and toward the end 43 of the tubular member 41 and having a valve seat 81. The bushing 71 also includes a fuel passage 83 which extends radially between the counter bore 79 and the outer, low pressure fuel chamber 23 and which is located between the end 75 of the central bore 73 and the valve seat 81. The counter bore 79 can also be considered a part of the fuel passage 83.

Located between the end wall 21 of the housing member 17 and the end of the armature structure 53 remote from the tubular member 41 is a spacer or member 91 which limits movement of the armature structure 53 to the left in the drawings. The spacer 91 member includes a central bore 93 permitting passage therethrough of an adjustment member which is still to be described and which engages the poppet valve or plunger 55.

The fuel injection pump 13 also includes, in surrounding relation to the inner cylindrical walls 19 and 33, a suitable bobbin 105 carrying a solenoid or coil 107 which, when electrically energized, operates to displace the armature structure 53 axially along the tubular member 41 in the direction to the right in the drawings. A suitable spring 111 biases the armature structure 53 in the direction to the left in the drawings and into engagement with the spacer 91 when the coil 107 is not electrically energized.

The armature and valve assembly 51 also includes the before mentioned poppet valve or plunger 55 which includes a stem portion 121 having a transverse end surface 123 remote from the end 43 of the tubular member 41, an outer surface 125 extending to the right in the drawings from the transverse end surface 123 and in sliding and sealing engagement with the central bore 73 of the bushing 71 to afford movement of the plunger or poppet valve 55 relative to the armature structure 53 in response to movement of the armature structure 53 relative to the tubular member 41 through a stroke length between first and second positions. The stem portion 121 also includes an end 127 closer to the end 43 of the tubular member 41.

The poppet valve or plunger 55 also includes a head portion 131 which extends from the end 127 of the stem portion 121 and which is located in the inner, high pressure fuel chamber 65 between the flange surface 63 of the armature structure 55 and the valve seat 81. The head portion 131 includes, in facing relation to the valve seat 81, a valve surface 133 which is spaced from the valve seat 81 when the plunger or poppet valve 55 is in the first position to afford fuel flow through the fuel passage 83 and the counter bore 79 from the outer, low pressure fuel chamber 23 to the inner, high pressure fuel chamber 65 and which is located in sealing engagement with the valve seat 81 on the bushing 71 when the plunger or poppet valve 55 is in the first position to preclude fuel flow between the low and high pressure fuel chambers 23 and 65 through the counter bore 73 and the fuel passage 83.

The fuel injection pump 13 also includes an adjustment member 141 extending in the axial bore 25 in the end wall 21 of the housing member 17 and having an inner end 143 engageable with the end surface 123 of the plunger or poppet valve 55 to control the stand off or spacing of the valve surface 133 from the valve seat 81 when the armature structure 53 is in the low pressure position. The stand off distance controls the amount of movement of the armature structure 53 before closure of the sealing or valve surface 133 with the valve seat 81 and hence the amount of transferred energy.

In this last regard, and in general, the greater the speed attained by the armature structure 53 before engagement of the valve surface with the valve seat, the greater the energy can be transferred to the fuel. Accordingly, the faster will be the increase in fuel pressure for delivery through a nozzle (not shown).

In addition, the fuel injection pump 13 also includes means for axially displacing the adjustment member 141 relative to the end wall 21 of the housing member 17 to vary the stand off distance, i.e., to variably axially locate the first position of the plunger or poppet valve 53 and thereby adjust the stroke length of the plunger or poppet valve 55.

While other constructions can be employed, in the disclosed construction, the adjustment member 141 comprises a screw which is threadedly engaged in the axial bore 25 in the end wall 21 of the housing member 17 to afford axial movement thereof incident to rotation thereof. Accordingly, an allen wrench (not shown) located in a suitable recess 151 in the head of the screw or adjustment member 141 can be employed to adjust the stroke of the plunger or poppet valve 55 relative to the armature structure 53 and thereby control the amount of fuel passing to the inner, high pressure chamber 65 during each cycle of operation. A suitable seal 153 can be employed between the end wall 21 of the housing member 17 and the adjustment member or screw 141 to prevent escape of fuel therebetween.

As compared to the construction disclosed in application Ser. No. 276,545, the stop member or adjusting piston thereof has been omitted, whereby adjustment of the stroke of the armature structure 53 is not directly controlled. Instead, the stroke length of the poppet valve 55 is controlled by controlling the amount of movement or the stroke length between the poppet valve or plunger 55 and the armature structure or member 53.

As a consequence of the construction disclosed above, the armature structure or member 53 is moveable relative to the tubular member 41 in a first direction (to the right in the drawing) in response to energization of the electrical coil 107 to pressurize the fuel in the high pressure fuel chamber 65 and in a second direction (to the left in the drawing) opposite to the first direction in response to the action of the spring 111.

Also as a consequence of the construction disclosed above, the plunger or poppet valve 55 has a stroke length between a first, non-engaged or spaced position wherein the valve surface 133 is spaced from the valve seat 81 to permit flow from the low pressure fuel chamber 23 to the high pressure fuel chamber 65 in response to movement of the armature structure or member 53 in the second direction, and a second or engaged position wherein the valve surface 133 is sealingly engaged with the valve seat 81 to prevent flow between the low and high pressure chambers 23 and 65. The first or spaced position is determined by engagement of the left end surface 123 of the plunger or poppet valve 55 with the inner 143 end of the adjustment screw or member 141.

In operation, energization of the coil 107 causes movement of the armature structure or member 53 from the low pressure position and to the right in the drawings against the action of the spring 111. At the initiation of such movement of the armature structure or member 53 from the low pressure position, the plunger or poppet valve 55 is located in the position spaced from the valve seat 81, whereby the low pressure and high pressure fuel chambers 23 and 65 are in communication through the radial fuel passage 83 and the counter bore 79. However, such initial movement of the armature structure 53 to the right effects travel of the valve seat 81 to the right and into sealing engagement with the valve surface 133 of the head portion 131 of the plunger or poppet valve 55. Upon such engagement, communication of the high pressure chamber 65 with the low pressure chamber 23 is terminated and the high pressure chamber is sealed. Due to the momentum associated with movement of the armature structure 53 to the right, pressure in the high pressure chamber 65 increases rapidly until the pressure operated outlet valve 49 opens, permitting fuel outflow from the high pressure chamber 65 and continued armature structure movement to the right.

In this last regard, and in general, the greater the speed attained by the armature structure 53 before engagement of the valve surface 133 with the valve seat 81, the greater the energy can be transferred to the fuel. Accordingly, the faster will be the increase in fuel pressure for delivery through a nozzle (not shown).

Variation in the amount of fuel pumped from the high pressure chamber 65 can be obtained by changing the stroke length of the plunger or poppet valve 55 by manipulation of the adjustment screw or member 141. More particularly, if the stroke length of the plunger or poppet valve 55 between the engaged and non-engaged positions is lengthened, the armature structure 55 will move through a greater or increased portion of the stroke length thereof before the valve seat 81 engages the valve surface 133 to seal or close the high pressure fuel chamber 65. Such increased movement portion before sealing of the high pressure fuel chamber 65 diminishes the effective volume of the high pressure chamber 65 and will diminish the quantity of fuel pumped by the pressure increasing stroke of the armature structure or member 53 incident to energization of the coil 107.

Upon deenergization of the coil 107 and completion of the pressure stroke of the armature structure 53, the spring 111 will cause armature structure movement to the left in the drawings to the low pressure position with the bushing 71 engaged with the spacer 91. Such movement of the armature structure 53 to the left also carries the poppet valve 55 to the left to effect, after initial movement, engagement of the end surface 123 of the plunger or poppet valve 55 with the adjustment member or screw 141, thereby limiting poppet valve movement to the left and effecting movement of the valve seat 81 away from the head portion 131 of the poppet valve 55 until the bushing 71 engages the spacer 91 to terminate movement to the left of the armature structure or member 53. Upon disengagement of the valve seat 81 from the valve surface 133, fuel flows through the radial fuel passage 83 and through the counter bore 79, thereby filling the increasing volume of the high pressure chamber 65 occurring during armature structure movement to the left. Accordingly, adjustment of the screw 141 is effective to provide fine regulation of the amount of fuel pumped incident to each electrical energization of the coil 107 and independently of operational control of the engine. The adjustment member or screw 141 therefore allows fine tuned control of power balance between the cylinders of a multi-cylinder internal combustion engine.

Various of the features of the invention are set forth in the following claims.

We claim:

1. A fuel injection pump comprising a housing including a wall having therein a bore, a low pressure fuel chamber communicating with a source of low pressure fuel, and a high pressure fuel chamber having a pressure controlled fuel outlet, an armature structure movably mounted in said housing for movement in a first direction pressurizing the fuel in said high pressure chamber and in an opposite direction, and including a fuel passage communicating between said low pressure fuel chamber and said high pressure fuel chamber and including therein a valve seat, an electrical coil mounted on said housing and operable, when energized, to cause armature structure movement in said first direction, a spring located in said housing and operable, when said coil is deenergized, to cause armature structure movement in said opposite direction, a poppet valve slidable within said fuel passage in said armature structure and relative thereto in response to movement of said armature structure relative to said housing and through a stroke length between a first position permitting flow in said fuel passage from said low pressure fuel chamber to said high pressure fuel chamber, and a second position preventing fuel flow between said high and low pressure fuel chambers, and comprising a head portion located in said high pressure fuel chamber and including a valve surface which is spaced from said valve seat when said poppet valve is in said first position permitting fuel flow from said low pressure fuel chamber to said high pressure fuel chamber, and which is sealingly engaged with said valve seat when said poppet valve is in said second position preventing fuel flow between said high and low pressure fuel chambers, an adjustment member extending in said bore in said housing wall and being engageable with said poppet valve to control the stroke length thereof between said fuel flow permitting and fuel flow preventing positions, and means for displacing said adjustment member relative to said housing end wall to variably determine the stroke length of said poppet valve.

2. A fuel injection pump comprising an elongated housing including an end wall having therein a central bore, an armature structure movably mounted in said housing, partially defining, with said housing, an outer fuel chamber communicating with a source of low pressure fuel, partially defining an inner fuel chamber having a pressure controlled fuel outlet, and including a central bore, a counter bore extending from said central bore in the direction away from said end wall of said housing, communicating with said outer and inner fuel chambers, and including a valve seat between said outer and inner fuel chambers, and a poppet valve slidable within said central bore of said armature structure and relative thereto in response to movement of said armature structure relative to said housing and through a stroke length between a first position permitting fuel flow between said outer and inner fuel chambers, and a second position preventing fuel flow between said outer and inner fuel chambers, and including a head portion located in said inner fuel chamber and including a valve surface which is spaced from said valve seat when said poppet valve is in said first position permitting fuel flow from said outer fuel chamber to said inner fuel chamber, and which is sealingly engaged with said valve seat when said poppet valve is in said second position preventing fuel flow between said outer and inner fuel chambers, an adjustment member extending in said axial bore in said end wall of said housing and engageable with said poppet valve, and means for axially displacing said adjustment member relative to said housing end wall to variably determine the stroke length of said poppet valve.

3. A fuel injection pump comprising a housing including an elongated wall having an axis, and an end wall which includes therein an axial extending bore and which, together with said elongated wall, partially defines an outer fuel chamber communicating with a source of low pressure fuel, an elongated member fixedly extending coaxially with said elongated wall and including an end spaced from said housing end wall, an armature structure movably mounted on said elongated member, defining with said elongated member an inner fuel chamber having a pressure controlled fuel outlet, and including a central bore extending coaxially with said elongated wall, a counter bore extending from said central bore toward said end of said elongated member and including a valve seat, and a fuel passage extending radially between said counter bore and said low pressure fuel chamber, a poppet valve including a stem portion slidable within said central bore of said armature structure and relative thereto in response to movement of said armature structure relative to said elongated member and through a stroke length between a first position permitting fuel flow between said outer and inner fuel chambers, and a second position preventing fuel flow between said outer and inner fuel chambers, and a head portion extending from said stem portion, located in said inner fuel chamber between said elongated member and said valve seat and including a valve surface which is spaced from said valve seat when said poppet valve is in said first position permitting fuel flow through said fuel passage and said counter bore from said outer fuel chamber to said inner fuel chamber, and which is sealingly engaged with said valve seat when said poppet valve is in said second position preventing fuel flow between said outer and inner fuel chambers through said counter bore and said fuel passage, an adjustment member extending in said axial bore in said end wall of said housing and engageable with said stem portion of said poppet valve, and means for axially displacing said adjustment member relative to said housing end wall to variably determine the stroke length of said poppet valve.

4. A fuel injection pump comprising a one piece housing member including a cylindrical wall, an end wall which, together with said cylindrical wall, defines a low pressure fuel pumping chamber and which includes therein an axial bore extending coaxially with said cylindrical wall, a tubular member fixedly extending coaxially with said cylindrical wall and including an end spaced from said end wall of said housing member, an outer surface, and an interior bore defining a pressure controlled fuel outlet, an armature assembly including an armature structure partially defining a high pressure fuel chamber communicating with said interior bore of said tubular member and being slideably mounted on said tubular member for movement in a first direction pressurizing the fuel in said high pressure fuel chamber and in a second direction opposite to said first direction, and including a first end adjacent said tubular member, a second end remote from said tubular member, an inner bore extending from said first end and having an inner surface slidingly and sealingly engaged with said outer surface of said tubular member, a transverse flange surface extending from said inner bore in axially spaced relation from said end of said tubular member, and a bushing located at said second end of said armature structure and having a central bore extending coaxially with said cylindrical wall and including an end axially spaced from said end of said tubular member, a counter bore extending from said end of said central bore of said bushing toward said end of said tubular member and having a valve seat, and a fuel passage extending radially between said counter bore and said low pressure fuel chamber, and a poppet valve including a stem portion having a first end having a transverse surface remote from said end of said tubular member, an outer surface extending from said transverse surface in slidable and sealing engagement with said central bore of said bushing to afford movement of said poppet valve relative to said armature structure in response to movement of said armature structure relative to said tubular member through a stroke length between a first position permitting fuel flow through said fuel passage and said counter bore from said low pressure fuel chamber to said high pressure fuel chamber, and a second position preventing fuel flow between said high and low pressure fuel chambers, a second end, and a head portion located in said high pressure fuel chamber between said flange surface of said armature structure and said valve seat and including a valve surface which is spaced from said valve seat when said poppet valve is in said first, fuel flow permitting position and which is sealingly engaged with said valve seat when said poppet valve is in said second, fuel flow preventing position, an adjustment member extending in said axial bore in said end wall of said housing member and having an outer end engageable with said end surface of said plunger, and means for axially displacing said adjustment member relative to said end wall of said housing member to variably determine the stroke length of said poppet valve.

* * * * *